US008169375B1

(12) United States Patent
Conrad

(10) Patent No.: US 8,169,375 B1
(45) Date of Patent: May 1, 2012

(54) STABILIZING MECHANISM AND METHOD FOR A STOWED MOBILE SATELLITE REFLECTOR ANTENNA

(75) Inventor: Timothy John Conrad, Mt. Pleasant, IA (US)

(73) Assignee: Winegard Company, Burlington, IA (US)

( * ) Notice: Subject to any disclaimer, the term of this patent is extended or adjusted under 35 U.S.C. 154(b) by 1227 days.

(21) Appl. No.: 11/863,889

(22) Filed: Sep. 28, 2007

(51) Int. Cl.
*H01Q 1/32* (2006.01)

(52) U.S. Cl. ..... 343/713; 343/711; 343/880; 343/881; 343/915

(58) Field of Classification Search ..... 343/711, 343/713, 912, 915, 880, 881, 882
See application file for complete search history.

(56) References Cited

U.S. PATENT DOCUMENTS 5,337,062 A 8/1994 Sherwood et al.
5,418,542 A 5/1995 Sherwood et al.
5,515,065 A 5/1996 Sherwood et al.
5,528,250 A 6/1996 Sherwood et al.
5,554,998 A 9/1996 Sherwood et al.
5,646,638 A 7/1997 Winegard et al.
6,023,247 A 2/2000 Rodeffer
6,188,300 B1 2/2001 Rodeffer
7,230,581 B2 6/2007 McEwan
2006/0038728 A1* 2/2006 McEwan ..... 343/713
2007/0013604 A1 1/2007 McEwan
2008/0055170 A1* 3/2008 Madden et al. ..... 343/713

* cited by examiner

*Primary Examiner* — Dieu H Duong
(74) *Attorney, Agent, or Firm* — Dorr, Carson & Birney, PC

(57) ABSTRACT

A stabilizing mechanism and method for a reflector antenna, in a mobile satellite system on a transport, such as a vehicle, for substantially minimizing damage to the reflector antenna when stowed. The stabilizing mechanism uses a stabilizing surface and a pair of stabilizing devices connected on opposite sides of the reflector antenna to provide a pre-load separation distance between a stabilizing surface and the reflector antenna when the reflector antenna is stowed. The pre-loaded separation minimizes any movement of the reflector antenna towards the stabilizing surface during movement of the transport or in adverse environmental conditions.

19 Claims, 8 Drawing Sheets

1100
1110
90
20
28

10
22
26
20
1100
90
150B
32B
70
40
50
60
30

Fig. 13
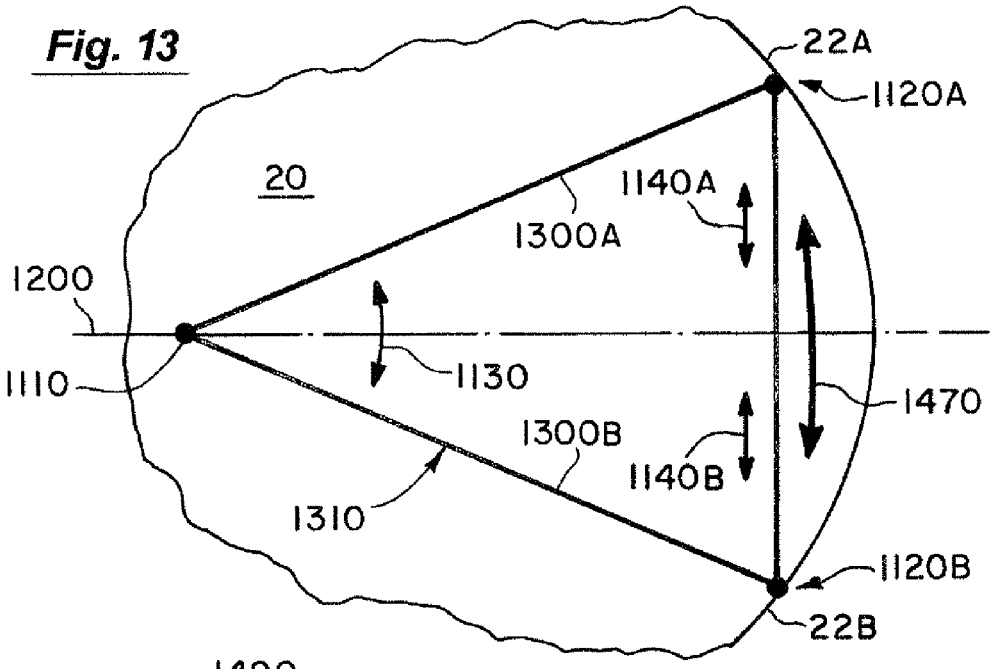
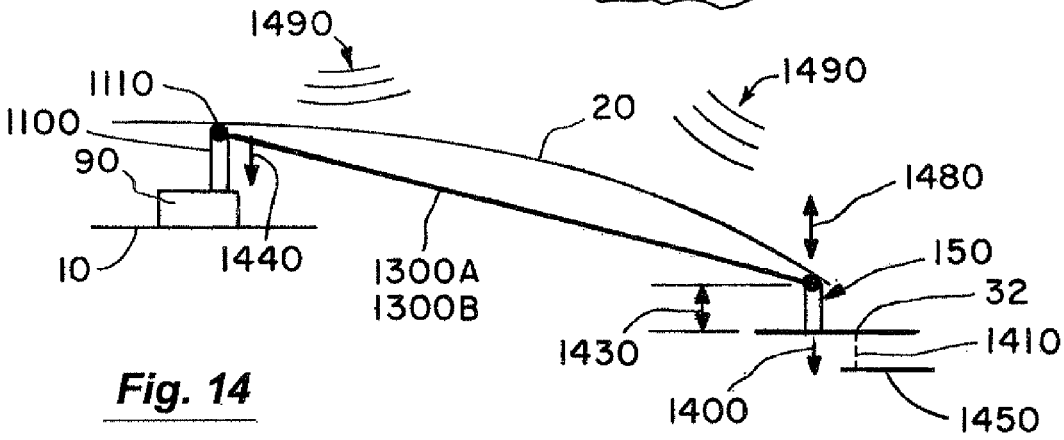
Fig. 14
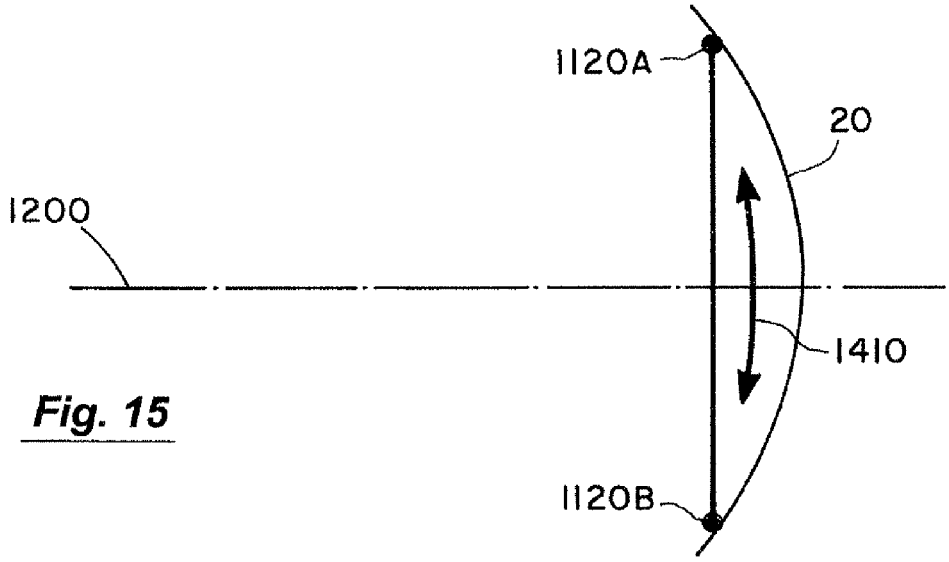
Fig. 15

STABILIZING MECHANISM AND METHOD FOR A STOWED MOBILE SATELLITE REFLECTOR ANTENNA

BACKGROUND OF THE INVENTION

1. Field of the Invention

The invention relates to the field of mobile satellite reflector systems and, more particularly, to mechanisms and methods for stabilizing stowed reflector antenna in mobile satellite systems so as to minimize damage under adverse environmental conditions or during movement of a transport carrying the mobile satellite system.

2. Discussion of the Background

Mobile satellite systems, mounted on a wide variety of vehicles, are used worldwide to provide two-way satellite communications such as, for example, broadband data, video conferencing and other corporate communications for such diverse uses such as, for example, found for oil and gas exploration, construction, military, mobile education, emergency medical and service providers, and news organizations. These systems need to be rugged and reliable, are often transported through difficult terrain and are subjected to severe weather environments. In use, the mobile satellite system deploys a reflector antenna and automatically targets it on a desired satellite in orbit. When not in use or in transit, the reflector antenna is stowed, usually in a low profile design, close to a transport surface such as the roof of a vehicle. Such systems are also shipped in containers.

The reflector antennas in such mobile satellite systems are large such as, for example, 1.2 meter in size. Such large reflectors when stowed can bounce and move. A need exists to minimize damage from the stowed reflector antenna hitting the transport surface due to mechanical stress such as high wind loads, transport over rough terrain, heavy snow and/or ice loads. The damage can occur to either or both the reflector antenna and to the transport surface.

SUMMARY OF THE INVENTION

A stabilizing mechanism for a reflector antenna, in a mobile satellite system mounted to a vehicle or mounted in a container, is provided to substantially minimize damage to the reflector antenna when stowed. The stabilizing mechanism uses a pair of stabilizing surfaces connected on opposite sides of the reflector antenna. A first end of each stabilizing device is connected on one of the opposing sides of the reflector antenna. The second end of each stabilizing device abuts, with a pre-load force, against a corresponding stabilizing surface in said pair of stabilizing surfaces when said reflector antenna is stowed. The stabilizing surface may be on the system, the mount for the system, or the vehicle or container transporting the system. The pre-loaded abutment minimizes any movement of the reflector antenna towards the stabilizing surface during transport or in adverse environmental conditions.

A method protecting a stowed reflector antenna in a mobile satellite antenna system encountering mechanical stress during transport. The method includes abutting a pair of stabilizing devices connected to opposite sides of the stowed reflector antenna against a stabilizing surface. The method further includes minimizing movement between the stabilizing surface and the stowed reflector antenna when the mobile satellite system encounters mechanical stress. The method further includes pre-loading the stabilizing devices against the stabilizing surface. The method also includes maintaining a separation distance between the reflector antenna and the stabilizing surface.

BRIEF DESCRIPTION OF THE DRAWINGS

FIG. 13 is an illustration showing the support triangle generated by the stabilizing mechanism and method of the present invention.

FIG. 14 is a side view of FIG. 13.

FIG. 15 is an illustration showing the support generated by the stabilizing mechanism and method of the present invention when used in another embodiment.

DETAILED DESCRIPTION OF THE INVENTION

Figure 1:
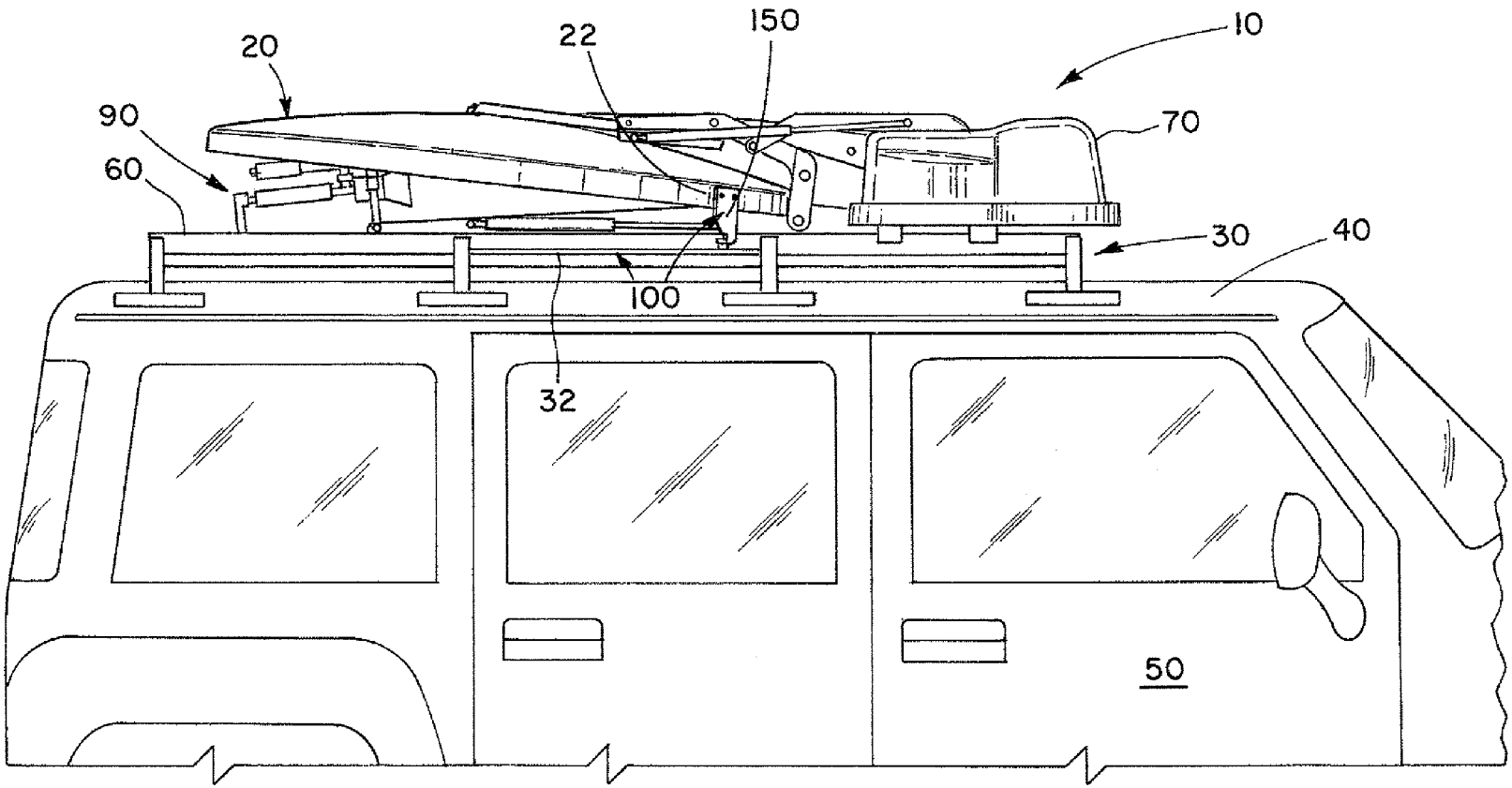
FIG. 1 is a perspective view of a mobile satellite system with the reflector antenna stowed.

In FIG. 1, the mobile satellite system 10 of the present invention is shown, with the reflector antenna 20 in a stowed position, on a conventional mount 30 on an upper surface 40 of a vehicle 50. The vehicle 50 can be any suitable vehicle such as a truck, van, SUV, trailer, RV, marine vessel, transport, etc. The mobile satellite system 10 may also be conventionally mounted in a container (not shown).

Figure 2:
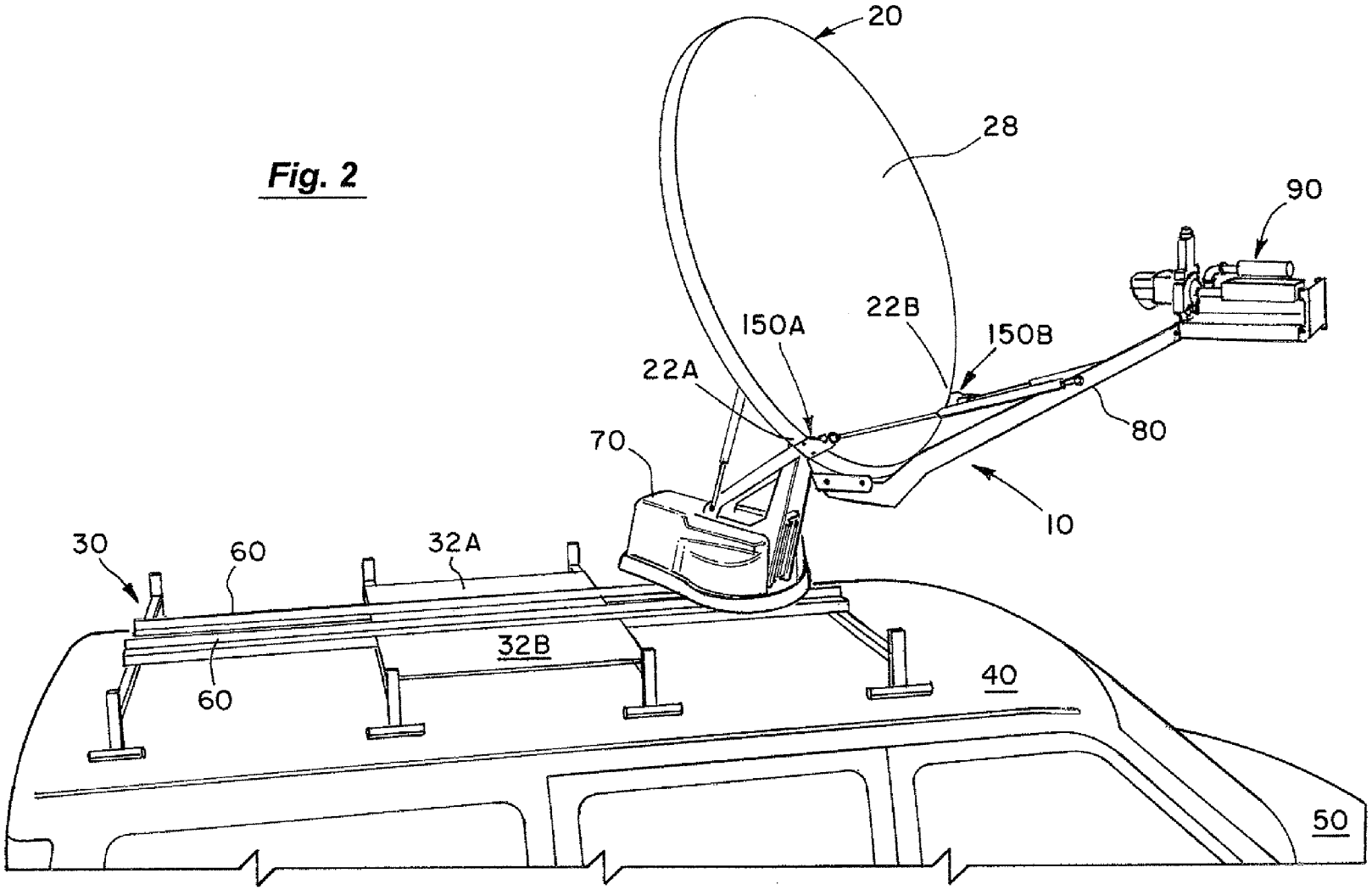
FIG. 2 is a perspective view of a mobile satellite system with the reflector antenna deployed.
Figure 3:
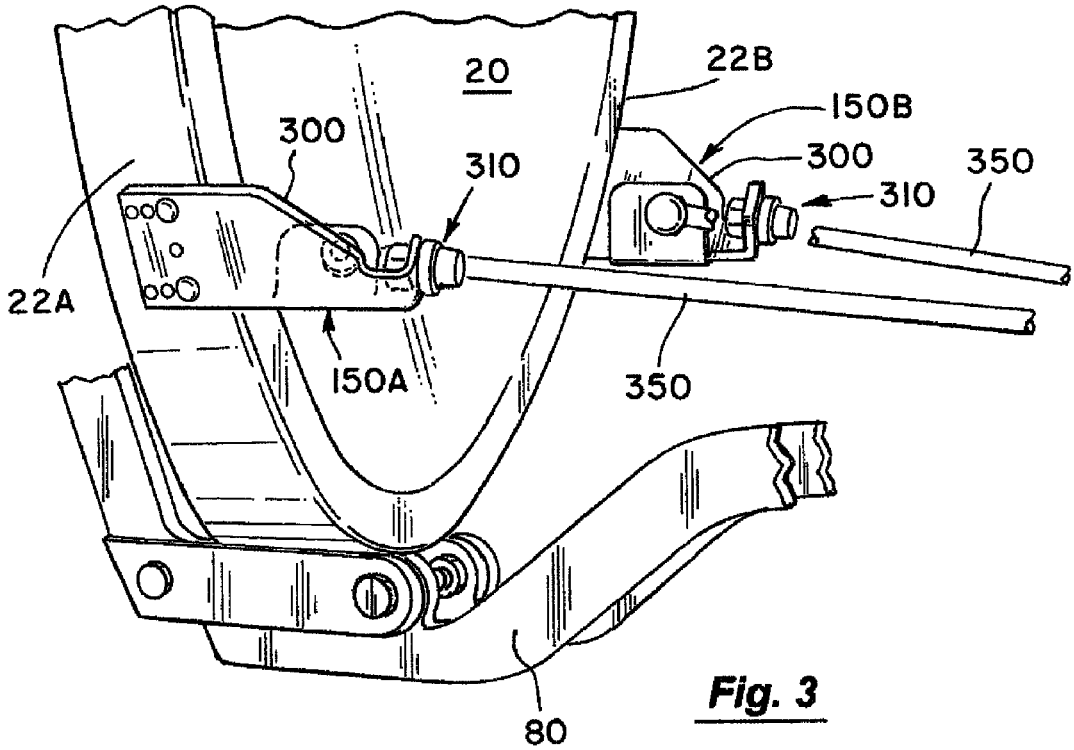
FIG. 3 is a partial perspective view of the stabilizing mechanism of the present invention.

FIG. 2 shows the reflector antenna 20 deployed and targeted on a desired orbiting satellite (not shown). The mobile satellite system 10 of FIGS. 1 and 2 conventionally has a pair of tracks 60 on a mount 30 on the vehicle surface 40; a housing 70 containing motors, gears, controls (all not shown); and a feed support arm 80 carrying a feed 90. The mount 30, in one embodiment, has opposing plates on opposite sides of the mount 30 which form a pair of stabilizing surfaces 32A, 32B. In another embodiment, the stabilization surface 32 is provided by the roof 40 of the vehicle 50 (or by the floor of a container). In another embodiment, the stabilizing surface may be part of the system 10.

The stabilizing mechanism 100 of the present invention can be used with any stowed reflector antenna 20 and is not limited to the mobile satellite system 10 illustrated in FIGS. 1 and 2. An example of a mobile satellite system 10 is set forth in U.S. Pat. No. 7,230,581 which is incorporated herein by reference. In another embodiment, the stabilizing surface 32 is provided by the roof 40 of the vehicle 40 (or the floor of a container). In another embodiment, the stabilizing surface may be part of the system 10. The stabilizing mechanism 100 uses a pair of stabilizing devices 150A, 150B connected on said opposite sides 22A, 22B of the reflector antenna 20, away from said feed 90 when stowed as shown in FIG. 1, and a stabilizing surface 32 such as a pair of stabilizing surfaces 32A, 32B on the mount 30.

In FIGS. 3 through 9, the details of each stabilizing device 150A, 150B in the stabilizing mechanism 100 are shown. The stabilizing devices 150A, 150B are not identical. One is "right-handed" and one is "left-handed," but the following components are the same. Each stabilizing device 150A, 1508 has a formed metal bracket 300 and a stabilizing bumper 310.

Figure 4:
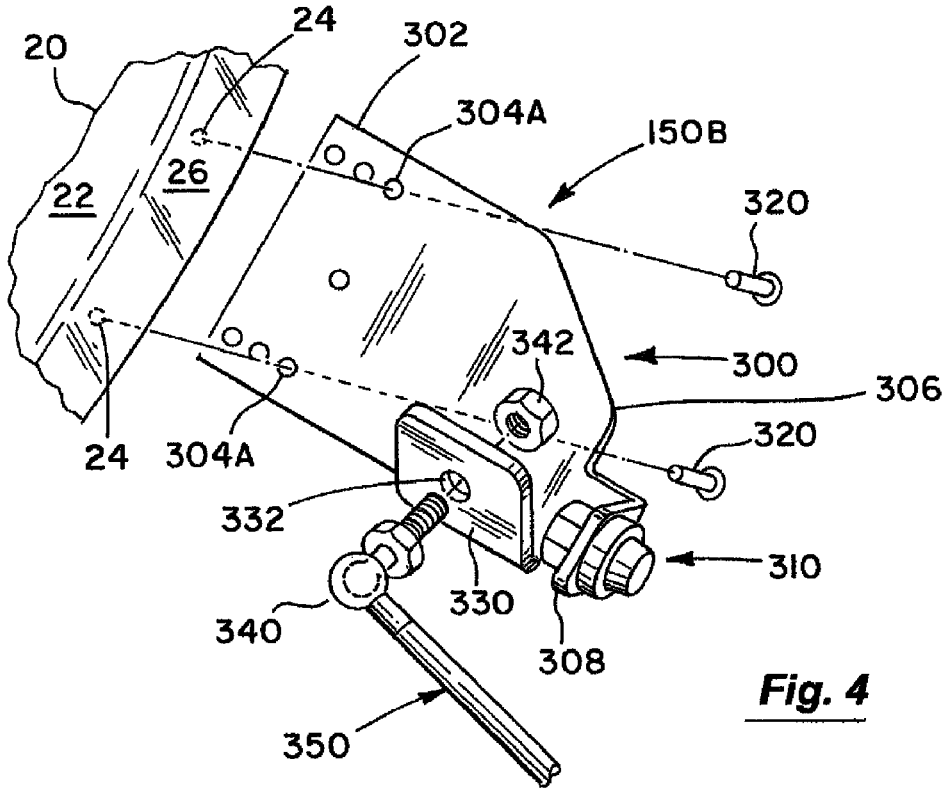
FIG. 4 is an exploded perspective view of the stabilizing device of the present invention.
Figure 8:
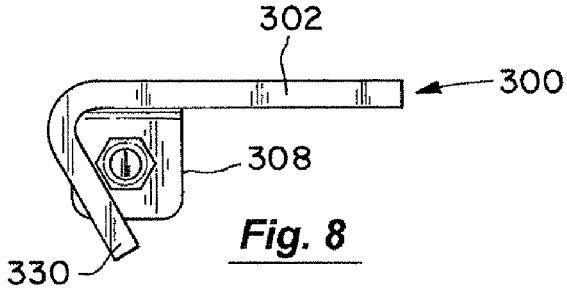
FIG. 8 is a top view of the stabilizing device of the present invention.

At one end 302 of the bracket 300 are formed connection holes 304. Three sets of holes 304 are illustrated, but any number of sets of holes 304 could be used. Each set of holes 304 align with corresponding formed holes 24 made in the outer edge 26 on an opposing side 22 of the reflector antenna 20 such as set 304A as shown in FIG. 4. Rivets 320 are used to firmly connect the bracket 300 to the reflector antenna 20. Any suitable connector 320, other than rivets, can be used to firmly connect the bracket 300 to the reflector antenna 20 such nuts/bolts, welding, etc.

At the other end 306 of the bracket 300 is an extension lip 308 formed at substantially a right angle to the bracket 300. The extension lip 308 has a formed hole 312 as also shown in FIG. 7.

Figure 7:
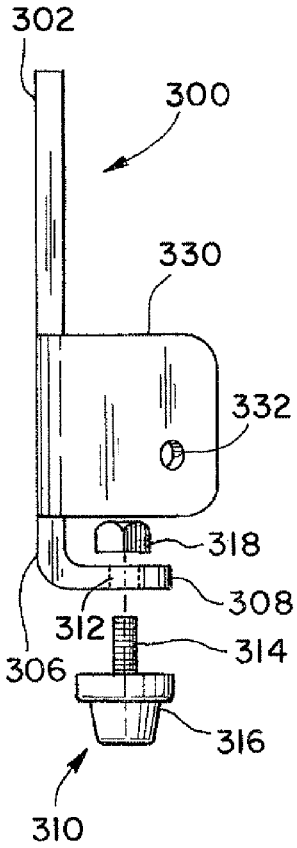
FIG. 7 is a left side view of the stabilizing device of the present invention.
Figure 5:
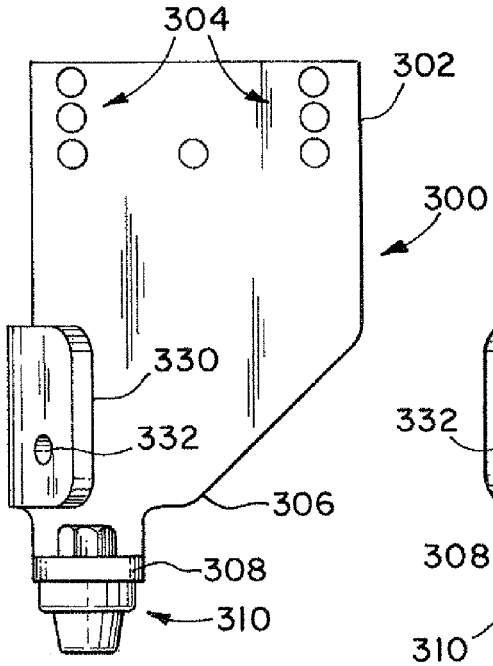
FIG. 5 is a front view of the stabilizing device of the present invention.
Figure 6:
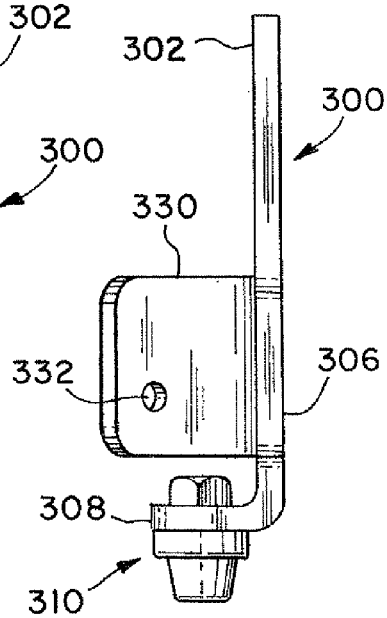
FIG. 6 is a right side view of the stabilizing device of the present invention.
Figure 9:
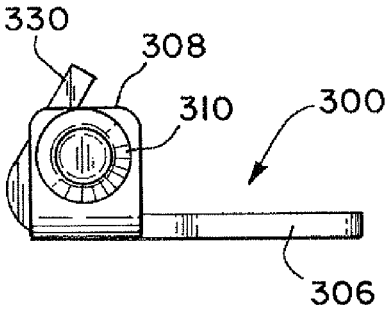
FIG. 9 is a bottom view of the stabilizing device of the present invention.

The stabilizing bumper 310 has a bolt 314 integral with a conically shaped shock absorber 316 as also shown in FIG. 7. The shock absorber 316 is made of a suitable shock absorbing material such as neoprene rubber or soft plastic that is oil and gasoline resistant, has a temperature range of −30° to +170° F., has a durometer hardness of about 50 A, and can with stand extreme weather conditions. The bolt 314 accesses the hole 312 of the extension lip 308 and is firmly connected to the extension lip 308 by lock nut 318. Any suitable connector can be used to firmly connect the bracket 300 to the stabilizing bumper 310.

Each stabilizing device 150A, 150B, as shown in FIGS. 3-9, provides a second extension 330 near the end 306 of bracket 300. The second extension 330 extends at an acute angle back towards the edge 24 of the reflector antenna 20. The second extension has a formed hole 332 which receives a ball head bolt 340 of a piston 350 as shown in FIG. 4. A lock nut 342 is used to connect the pivot head bolt 340 firmly to the second extension 330. The second extension 330 and piston 350 are environmentally shown, but are not required for operation of the present invention.

Figure 10:
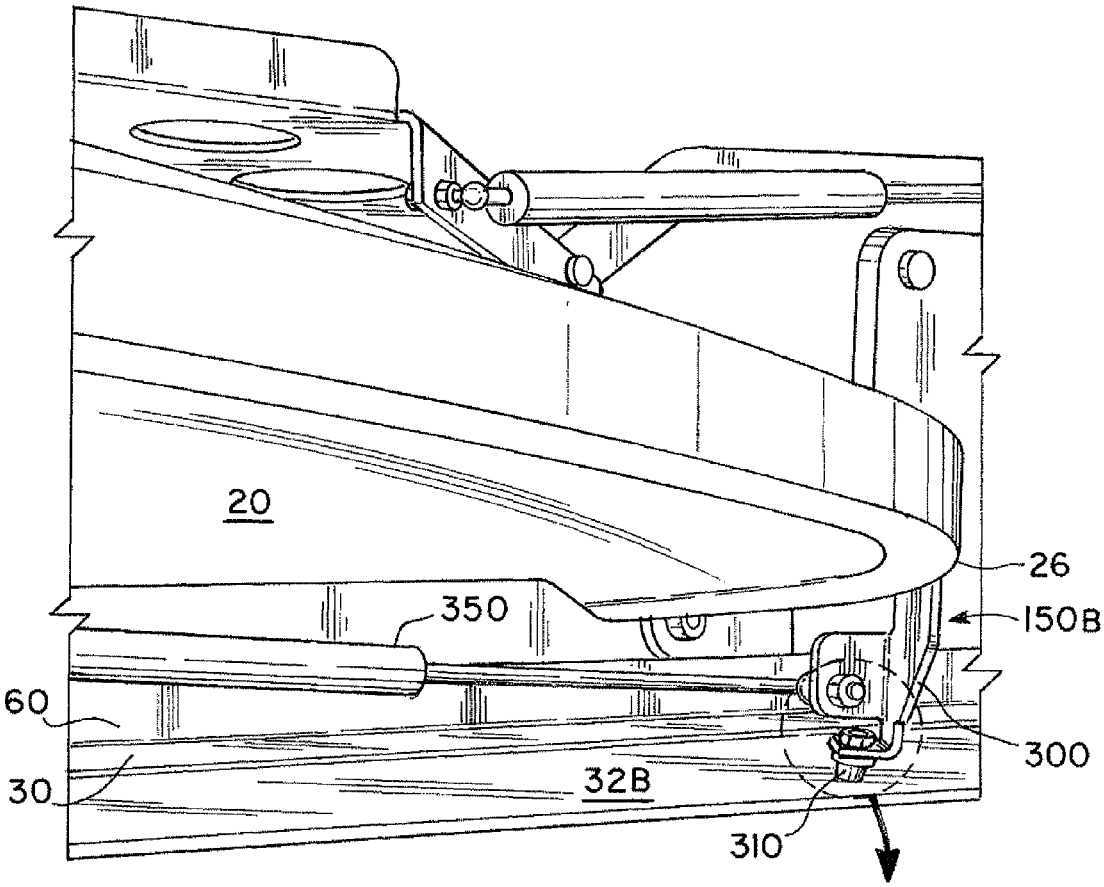
FIG. 10 is a partial perspective view of a stabilizing device of the present invention abutting against a stabilizing surface.

In FIG. 10, the operation of each stabilizing device 150A, 150B is shown as the reflector antenna 20 lowered into a stowed position with respect to stabilizing device 1508. When the reflector antenna 20 is stowed, the stabilizing device 150B abuts against stabilizing surface 32B. Stabilizing surfaces 32A, 32B, based on the specific design requirements of the mobile satellite system 10 and the vehicle 50, can be any suitable stabilizing surface 32 such as an extension from the mobile satellite system 10 itself (such as, for example, from rails 60), a component of the mount 30 (such as the plates 32A and 32B shown), the surface 40 of the vehicle 50, the floor of a transport container, etc. In a typical use, the mobile satellite system 10 mounts 30 to the roof 40 of a vehicle 50 and the stabilizing surface 32 is the roof 40 with the sets of holes 304 chosen so that the bumpers 310 abut the roof 40 (the roof 40 in this embodiment is the stabilizing surface 32). All of these stabilizing surfaces are on the vehicle 50. As previously discussed, the bracket 300 has sets of holes 304 which provide adjustability to set the stabilizing devices 150A, 1508 so that the stabilizing bumpers 310 abut against the stabilizing surface 32 on the vehicle 50 whether the stabilizing surface 32 is part of the mobile satellite system 10, the mount 30 or the vehicle 50.

Figure 10A:
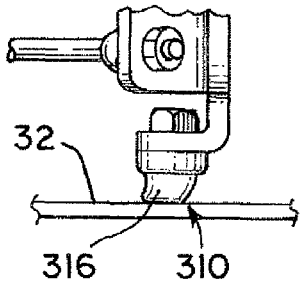
FIG. 10*a* is an illustration showing deformation of the stabilizing bumper.

As shown in FIG. 10*a*, the shock absorber 316 of the stabilizing bumper 310 firmly abuts against the stabilization surface 32 and may undergo distortion 1200 to provide a firm abutment of the reflector antenna 20 against the stabilizing surface 32. The stabilizing bumper pre-loads against the stabilizing surface 32 with a small force of about several pounds so as to firmly abut against the stabilizing surface 32, when the reflector antenna 20 is stowed. This pre-loads the stowed reflector antenna 20 against the stabilizing surface 32. In FIG. 10*a*, the stabilizing surface 32 may be the pair of stabilizing surfaces 32A, 32B located on the mount 60. In another embodiment the pair of stabilizing surfaces 30A, 30B may be located on the mobile satellite system 10 such as being connected near the rails 60. In another embodiment, the stabilizing surface 32 may be on the upper surface of the vehicle 40 such as the roof of a vehicle. In another embodiment, the stabilizing surface 32 is the floor of a transport container. The stabilizing surface 32 in FIG. 10*a* is shown generically to represent any stabilizing surface 32 that provides support for the stabilizing bumpers 310 of the present invention to abut against and substantially prevent the reflector antenna 20 from harmful movement due to mechanical stresses as will be discussed later.

Figures 11, 11A:
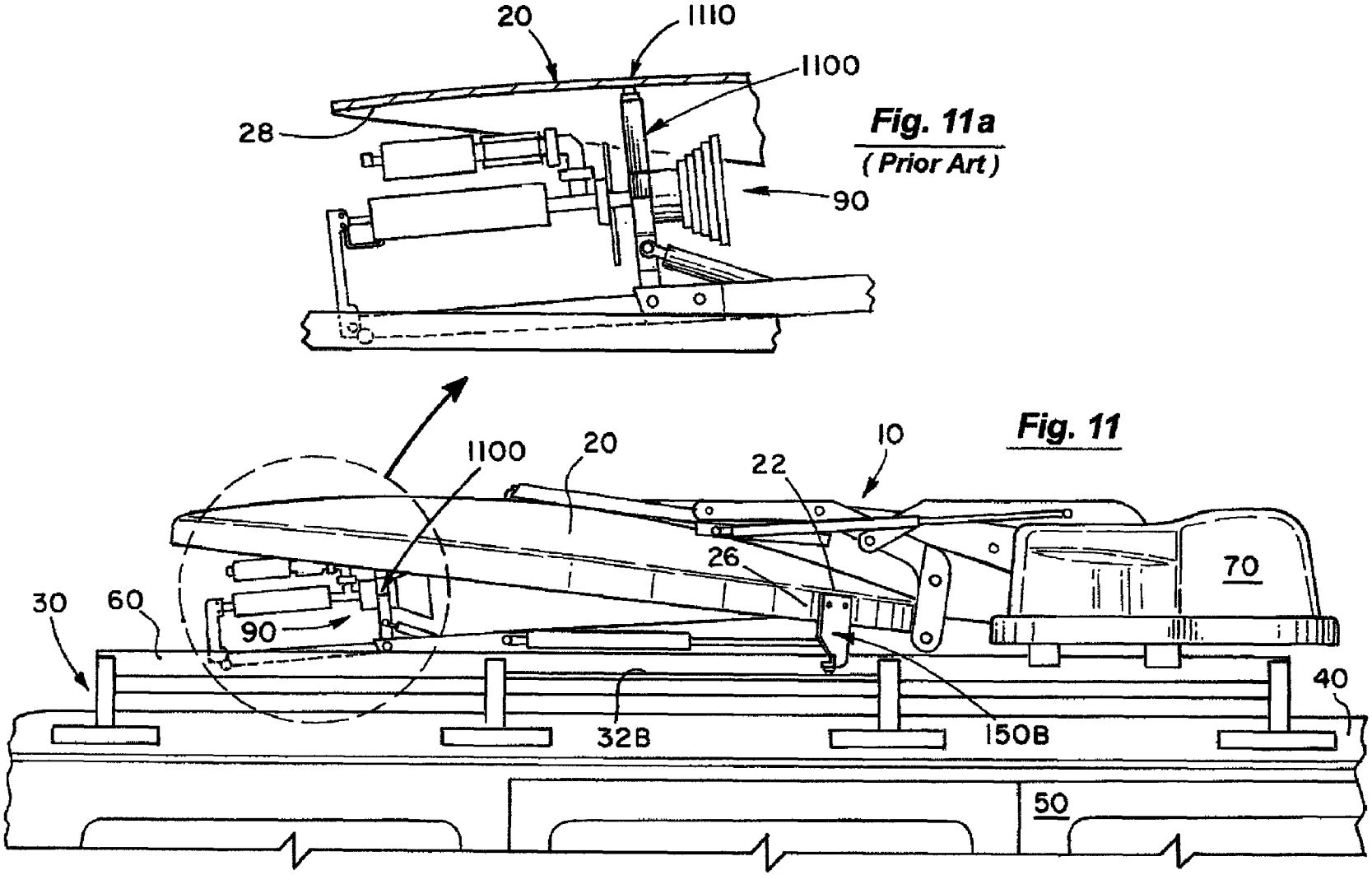
Fig. 11a (Prior Art)
FIG. 11 is a perspective view of a stowed reflector antenna with a partial cut-away showing the primary stabilization bumper.
FIG. 11*a* (PRIOR ART) shows the primary stabilization bumper abutting the stowed reflector antenna in a side cut-away view.
Figure 12:
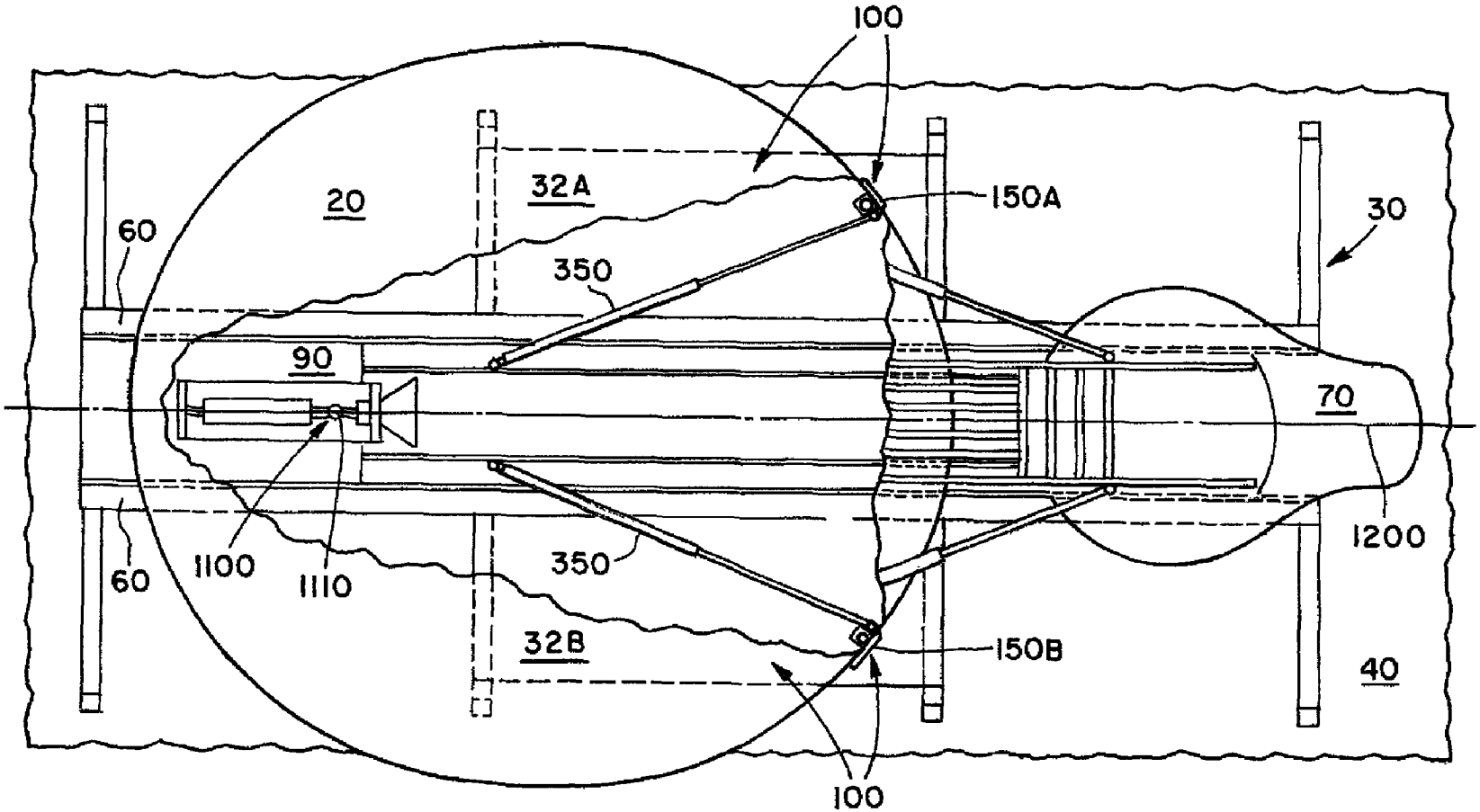
FIG. 12 is a top planar view of the stowed reflector antenna with a partial cut-away showing the stabilizing mechanism of the present invention.

In FIG. 11, the reflector antenna 20 is stowed (as also shown in FIG. 1). Here, the stabilizing device 150B abuts stabilizing surface 32B as discussed with respect to FIG. 10. In FIG. 11*a*, a conventional, primary stabilizing bumper 1100 is shown mounted to feed 90. Use of such primary stabilizing bumpers 1100 is conventional and the design of the stabilizing bumper 1100, how it is mounted to the feed 90 and its location varies based on specific design requirements. For purposes of the present invention, the primary stabilizing bumper 1100 abuts against the inner reflective surface 28 of the reflector antenna 20 when the reflector antenna is fully stowed to stabilize the reflector antenna 20 from damage. For purposes of this invention, this primary stabilizing bumper 1100 provides a primary stabilization point 1110 on the centerline 1200 of the stowed reflector antenna 20 in the mobile satellite system 10 as shown in FIG. 12.

The operation of the stabilizing mechanism 100 having a pair of stabilizing devices 150A, 150B and a surface 32 such as a pair of surfaces 32A, 32B is now discussed with respect to FIGS. 13 and 14. In FIG. 13, the reflector antenna 20, in the stowed position of FIGS. 11 and 12, conventionally stows against a primary stabilization bumper 1100 at primary stabilization point 1110. The conventional primary stabilizing bumper 1100 is located on a center line 1200 as shown in FIG. 13. The stowed reflector antenna 20 also abuts the pair of stabilizing devices 150 of the present invention against the stabilizing surface 32 such as a pair of surfaces 32A, 32B at stabilizing points 1120A and 1120B which are located on opposite sides 22A, 22B of the reflector antenna 20 away from the feed 90 when stowed. Lines 1300A and 1300B are shown drawn from the primary stabilizing bumper 1100 point of contact 1110 on center line 1200 and through points 1120A and 1120B. This creates an angle 1130 about the centerline 1200. While the angle 1300 of the present invention is not limited to a range. The angle selected, in one embodiment, positions the stabilizer bumpers 1100 close to centerline 1200 so that when the mobile satellite system 10 is mounted to the roof 40 of a vehicle 50 and when the roof 40 is the stabilizing surface 32 the curved slope of the roof 40 is avoided when the bumpers 310 abut the roof 40.

FIG. 13 illustrates a support triangle 1310 formed by the use of the stabilizing mechanism 100, in one embodiment of the present invention, in conjunction with the primary stabilizing bumper 1300. The reflector antenna 20 is firmly stowed against three points 1110, 1120A, and 1120B in the support triangle 1310. The points 1120A, 1120B are at the same set distances 1140A, 1140B from the centerline 1200. The reflector antenna 20 pre-loads against stabilizing surface 32 at points 1120A and 1120B as shown by arrow 1400 in FIG. 14 and against the primary stabilizing bumper 1300 as shown by arrow 1440. The support triangle 1310 substantially minimizes movement between the reflector antenna 20 and the feed 70 and the stabilizing surface 32 by maintaining a separation distance 1430.

As discussed with respect to FIG. 10*a*, the stabilizing surface 32 can be formed from any suitable surface with a solid mechanical link 1410 to a transport 1450 such as on the roof 40 of a vehicle 50. The mechanical link 1410 on transport 1450 in various embodiments is provided by locating the stabilizing surface on the mobile satellite system 10 or on the mount 30. The stabilizing surface 32 may also be the floor of a trailer, the floor of a transport container, etc. Any mechanical stress 1490 due to vibration (or snow or ice load) from side to side (as shown by arrow 1470), in a vertical direction (as shown by arrow 1480), or combination of side-to side and vertical movement is substantially reduced thereby minimizing damage to the reflector antenna 20 during transport of the satellite mobile system 10 over severe terrain or during adverse environmental conditions.

In other embodiments, the bracket 300 can be made without the extension 308, The bracket 300 does not have to be the design shown in FIGS. 5 through 9, but can be any design that connects the stabilizing bumper 310 to the reflector antenna 20 to provide stabilizing points 1120A, 1120B to stabilizing surfaces 32A, 32B.

The stabilizing mechanism 100 does not have to be the design shown in FIGS. 5 through 9, but can be of any design that connects the shock absorber 316 to the reflector antenna 20. By way of illustration (and not limitation), the bracket 300 is eliminated and the stabilizing bumper 310 is elongated to connect directly to the edge 24 reflector antenna 20. In another embodiment, the stabilizing bumper 310 is not mounted to the reflector antenna 20, but is mounted to the stabilizing surface 32. The particular structure, design and placement of the stabilizing bumper 310 (or the shock absorber 316) can vary while still maintaining the support points 1120A and 1120B in respect to primary stabilizing point 1110. In another embodiment of the stabilizing mechanism 100 of the present invention, the primary stabilizing bumper is not used in the mobile satellite system 10. This is illustrated in FIG. 15. Only the stabilizing devices 150 are used to minimize damage to the reflector antenna 20 or to the surface 30 due to the reflector antenna 20 hitting the stabilizing surface 32 at points 1120A and 1120B.

The method of the present invention as shown in FIG. 14 protects the stowed reflector antenna 20 in the mobile satellite antenna system 10 when the system 10 encounters mechanical stress 1490 as shown in FIG. 14. The method occurs by abutting the pair of stabilizing devices 150A, 150B, connected to opposite sides 22A, 22B of the reflector antenna 20 when the antenna 20 is stowed, against a stabilizing surface. The method further occurs by minimizing movement between the stabilizing surface 32 and the stowed reflector antenna 20 when the mobile satellite system encounters mechanical stress 1490. The method includes pre-loading the stabilizing devices 150A, 150B against the stabilizing surface 32. The method includes maintaining a separation distance between the reflector antenna 20 and the stabilizing surface 32.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A stabilizing mechanism for a reflector antenna in a mobile satellite system, said mobile, satellite system mounted to a transport, said stabilizing mechanism comprising:
- a stabilizing surface on said transport;
- a pair of stabilizing devices connected on opposite sides of said reflector antenna;
- a first end of each stabilizing device in said pair connected on one of said opposing sides of said reflector antenna;
- said pair of stabilizing devices abutting, with a pre-load force, against said stabilizing surface with each stabilizing device abutting a different portion of said stabilizing surface when said reflector antenna is stowed in said mobile satellite system to minimize movement of said reflector towards said stabilizing surface.

2. The stabilizing mechanism of claim 1 wherein said transport is a vehicle, said vehicle having a roof and wherein said stabilizing surface is said roof.

3. The stabilizing mechanism of claim 1 wherein said mobile satellite system comprises a feed and wherein said pair of stabilizing devices are connected on said opposite sides of said reflector antenna away from said feed when said reflector antenna is stowed in said mobile satellite system.

4. A stabilizing mechanism for a reflector antenna in a mobile satellite system, said mobile satellite system mounted to a transport, said stabilizing mechanism comprising:
- a stabilizing surface on said transport;
- a pair of stabilizing devices connected on opposite sides of said reflector antenna;
- a first end of each stabilizing device in said pair connected on one of said opposing sides of said reflector antenna;
- said pair of stabilizing devices abutting, with a pre-load force, against said stabilizing surface when said reflector antenna is stowed in said mobile satellite system to minimize movement of said reflector towards said stabilizing surface wherein said mobile satellite system further comprises a mount for attaching said satellite mobile system to said transport, and wherein said stabilizing surface comprises a pair of stabilizing surfaces located on opposite sides of said mount.

5. A stabilizing mechanism for a reflector antenna in a mobile satellite system, said mobile satellite system mounted to a transport, said stabilizing mechanism comprising:
- a stabilizing surface on said transport;
- a pair of stabilizing devices connected on opposite sides of said reflector antenna;
- a first end of each stabilizing device in said pair connected on one of said opposing sides of said reflector antenna;
- said pair of stabilizing devices abutting, with a pre-load force, against said stabilizing surface when said reflector antenna is stowed in said mobile satellite system to minimize movement of said reflector towards said stabilizing surface wherein each stabilizing device in said pair comprises:

a bracket, said bracket having said first, end connected to one of said opposing sides of said reflector antenna;

a stabilizing bumper, said stabilizing bumper connected to a second end of said bracket, said stabilizing bumper composed of shock absorbing material that deforms against said stabilizing surface under said pre-load force.

6. The stabilizing mechanism of claim 5 wherein said stabilizing bumper further comprises:

a shock absorber;

a connector integrally embedded in the shock absorber, said connector connecting said stabilizing bumper to said second end.

7. A stabilizing mechanism for a reflector antenna when in a stowed position in a mobile satellite system, said mobile satellite system mounted to a transport, the stabilizing mechanism comprising:

a pair of stabilizing surfaces on said transport;

a pair of brackets positioned on opposite sides of said reflector antenna, each bracket in said pair having a first and a second end, said first end of each bracket connected on an opposing side of said reflector antenna;

a stabilizing bumper connected to said second end of each bracket in said pair of brackets;

each said stabilizing bumper abutting against one of said pair of stabilizing surfaces to minimize movement of said reflector when said reflector antenna is in said stowed position.

8. The stabilizing mechanism of claim 7 wherein said transport is a vehicle, said vehicle having a roof, and further comprising a mount for attaching said satellite mobile system to said roof, said pair of stabilizing surfaces located on said mount.

9. The stabilizing mechanism of claim 7 wherein said transport is a vehicle, said vehicle having a roof, and wherein said pair of stabilizing surfaces is on said roof.

10. The stabilizing mechanism of claim 7 wherein each stabilizing bumper comprises:

a shock absorbing material that deforms against said one stabilizing surface under a pre-load force.

11. The stabilizing mechanism of claim 7 wherein each said stabilizing bumper further comprises:

a shock absorber;

a connector integrally embedded in to the shock absorber, said connector connecting each said stabilizing bumper to said bracket.

12. The stabilizing mechanism of claim 7 wherein said mobile satellite system comprises a feed and wherein said pair of stabilizing brackets are connected on said opposite sides of said reflector antenna away from said feed when stowed said reflector antenna is stowed in said mobile satellite system.

13. A stabilizing mechanism for a reflector antenna when stowed in a mobile satellite system, the mobile satellite system having a feed arm carrying a feed, a main stow stabilizing bumper connected at one end to said feed, the main stow stabilizing bumper oriented on a centerline of the reflector antenna and abutting against the reflector antenna when said reflector antenna is stowed in said mobile satellite system, the stabilizing mechanism comprising:

a stabilizer surface;

a pair of stabilizing devices, a first end of each stabilizing device in said pair connected on an opposite side of said reflector antenna that is positioned a set distance away from said centerline and away from said feed, said pair of stabilizing devices abutting against said stabilizing surface when said reflector antenna is stowed in said mobile satellite system;

said main stow stabilizing bumper abutting against the reflector antenna;

said abutting pair of stabilizing devices and said abutting main stow stabilizing bumper forming corners of a support triangle for the reflector antenna when said reflector antenna is in said stowed position to minimize movement between said stowed reflector antenna and said feed and pair of stabilizing surfaces.

14. The stabilizing mechanism of claim 13 wherein each stabilizing device in said pair comprises:

a bracket, said bracket having said first end connected to said opposing side of said reflector antenna;

a stabilizing bumper, said stabilizing bumper connected to a second end of said bracket, said stabilizing bumper composed of shock absorbing material that deforms against said stabilizing surface under said pre-load force.

15. The stabilizing mechanism of claim 14 wherein said stabilizing bumper further comprises:

a shock absorber;

a connector integrally embedded in said shock absorber, said connector connecting said stabilizing bumper to said second end.

16. A method of stabilizing a stowed reflector antenna in a mobile satellite system, the method comprising:

abutting a pair of stabilizing devices connected on opposite sides of the stowed reflector antenna against a stabilizing surface with each stabilizing device abutting a different portion of said stabilizing surface;

maintaining a set distance between the reflector antenna and the stabilizing surface during abutment of the pair of stabilizing devices when the mobile satellite system encounters mechanical stress;

minimizing movement between the stabilizing surface and the stowed reflector antenna with shock absorbing material in the stabilizing devices during the mechanical stress.

17. The method of claim 16 further comprising:

providing the stabilizing surface on the roof of a vehicle.

18. The method of claim 16 further comprising:

providing the stabilizing surface on a mounting surface for the mobile satellite system.

19. The method of claim 16 wherein abutting further comprises:

pre-loading the pair of stabilizing devices against the stabilizing surface.

* * * * *